US010315077B2

(12) United States Patent
Komatsu

(10) Patent No.: US 10,315,077 B2
(45) Date of Patent: Jun. 11, 2019

(54) GOLF BALL WITH BUILT-IN IC CHIP

(71) Applicant: BRIDGESTONE SPORTS CO., LTD., Tokyo (JP)

(72) Inventor: Atsushi Komatsu, Chichibu (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 9 days.

(21) Appl. No.: 15/604,765

(22) Filed: May 25, 2017

(65) Prior Publication Data

US 2017/0368424 A1 Dec. 28, 2017

(30) Foreign Application Priority Data

Jun. 24, 2016 (JP) ..... 2016-125264

(51) Int. Cl.
*A63B 37/06* (2006.01)
*A63B 43/00* (2006.01)
*A63B 37/00* (2006.01)

(52) U.S. Cl.
CPC ..... *A63B 43/004* (2013.01); *A63B 37/0074* (2013.01)

(58) Field of Classification Search
CPC ..... A63B 37/0051
USPC ..... 473/353
See application file for complete search history.

(56) References Cited

U.S. PATENT DOCUMENTS 6,605,009 B1 * 8/2003 Nakamura ..... A63B 37/0003 473/374
2012/0256731 A1 * 10/2012 Luciano, Jr. ..... A63B 37/0003 340/10.1
2013/0165261 A1 * 6/2013 Luciano, Jr. ..... A63B 37/005 473/371
2013/0324313 A1 * 12/2013 Tachibana ..... A63B 37/0054 473/373

FOREIGN PATENT DOCUMENTS

JP 2016-007496 A 1/2016

* cited by examiner

*Primary Examiner* — Raeann Gorden
(74) *Attorney, Agent, or Firm* — Sughrue Mion, PLLC

(57) ABSTRACT

A golf ball includes: a radio frequency identification (RFID) tag including an IC chip and an antenna; a protection layer surrounding the outer periphery of the RFID tag; a relaxation layer surrounding the outer periphery of the protection layer; a core surrounding the outer periphery of the relaxation layer; and a cover surrounding the outer periphery of the core. The curing temperature of the protection layer is 60° C. or less, and the protection layer is formed with a material having a hardness of Shore D 60 or more. The relaxation layer is formed with a thermoplastic elastomer-based material having a hardness with a difference from a hardness of a surface of the core on a side contacting the relaxation layer of Shore D 20 or less.

17 Claims, 1 Drawing Sheet

GOLF BALL WITH BUILT-IN IC CHIP

CROSS-REFERENCE TO RELATED APPLICATION

This application claims priority from Japanese Patent Application No. 2016-125264 filed Jun. 24, 2016, which is incorporated herein by reference in its entirety.

BACKGROUND OF THE INVENTION

The present invention relates to a golf ball with a built-in integrated circuit (IC) tag such as a radio-frequency identification (RFID) chip.

In order to record information about golf balls, such as the material, the location of production, and the production date in the golf balls, attempts have been made to incorporate an IC chip into golf balls.

For example, JP 2016-7496 A discloses a golf ball in which an IC chip surrounded by a protection layer is arranged in the center of the golf ball. It is recited in JP 2016-7496 A that this protection layer is formed of a material with the Shore D hardness of 30 or more and that a material with a high fusion point of 80° C. or more such as a thermoplastic elastomer and a thermoplastic resin is used, for example. In addition, a solid core constituted by a conventional rubber composition is formed around the protection layer, and a cover constituted by a conventional resin composition covers over the solid core.

SUMMARY OF THE INVENTION

In incorporating an IC tag in a golf ball, because a golf ball is greatly deformed at the moment it is hit, the built-in IC chip may be damaged and communication failure may result. The protection layer is provided to prevent this problem. Based on the results of the experiment carried out by the inventor, it has been found that if the hardness of the protection layer is less than Shore D 60, there is a possibility of damage to the IC chip, and on the other hand, if the hardness of the protection layer is Shore D 60 or more, the core may be broken or separated because concentration of stress and the like result due to a large difference between the hardness of the protection layer and the hardness of the core arranged on the outside of the protection layer. The concentration of stress can be prevented by using a core with a high hardness for the core that contacts the protection layer, but in this configuration, a problem may be caused such that the hardness of the entire golf ball may become excessively high.

In addition, as an IC chip or an IC tag, a passive type which operates with electric waves received from an external reading apparatus as an energy source and an active type which uses a built-in battery cell have been used. Among them, use of the passive type chip or tag with a built-in battery cell has been desired because the communication distance to the reading apparatus is longer than that of the passive ones. However, because the active type chip or tag includes a built-in battery cell, the active type chip or tag is affected by heat more easily than the passive type chip or tag, and a problem may thus be caused such that if the material with a high fusion point disclosed in JP 2016-7496 A is used, failure of communication with the IC chip may occur as early as the stage of production of the golf ball.

In order to solve the above-described problems, an object of the present invention is to provide a golf ball with a built-in IC chip capable of preventing damage on the IC chip which may occur at the time of hitting the golf ball, preventing breaking and separation of a core, and maintaining the durability of the golf ball, and further preventing occurrence of failure of communication by the IC chip which may occur due to the production process for the golf ball.

In order to achieve the above-described object, a golf ball with a built-in IC chip according to the present invention includes: an IC chip; a protection layer surrounding an outer periphery of the IC chip, a curing temperature of the protection layer being 60° C. or less and the protection layer being formed with a material having a hardness of Shore D 60 or more; a relaxation layer surrounding an outer periphery of the protection layer; a core surrounding an outer periphery of the relaxation layer, the core being formed with a rubber composition; and a cover surrounding an outer periphery of the core, wherein the relaxation layer is formed with a thermoplastic elastomer-based material having a hardness with a difference from a hardness of a surface of the core on a side contacting the relaxation layer of Shore D 20 or less.

The protection layer may have a substantially spherical outer shape with a diameter of 3 to 30 mm. The IC chip may constitute the RFID tag together with an antenna connected with the IC chip. In this configuration, the protection layer is configured so as to surround the outer periphery of the RFID tag.

A polyester-based thermoplastic elastomer may be used as the thermoplastic elastomer. The hardness of the material of the relaxation layer may be less than the hardness of the surface of the core contacting the relaxation layer. In addition, the hardness of the material of the relaxation layer may be Shore D 20 to 50. The material of the protection layer may be an epoxy resin which cures at room temperature.

According to the present invention, the protection layer surrounding the outer periphery of the IC chip is formed with a material having a hardness of Shore D 60 or more, and thus deformation of the protection layer occurring when the golf ball is hit can be prevented. In addition, the relaxation layer is arranged between the protection layer having the very high hardness and the core formed with a rubber composition which is a material having a low hardness, the relaxation layer is formed with a thermoplastic elastomer-based material having a hardness with a difference from a hardness of the surface of the core on the side contacting the relaxation layer of Shore D 20 or less, and thus breaking and separation of the core can be prevented and the durability of the golf ball can be maintained. Further, the protection layer is formed with a material having a curing temperature of 60° C. or less, and thus, failure of communication with the IC chip, which may otherwise occur due to heat applied during formation of the protection layer, can be prevented.

DETAILED DESCRIPTION OF THE PREFERRED EMBODIMENT

Figure 1:
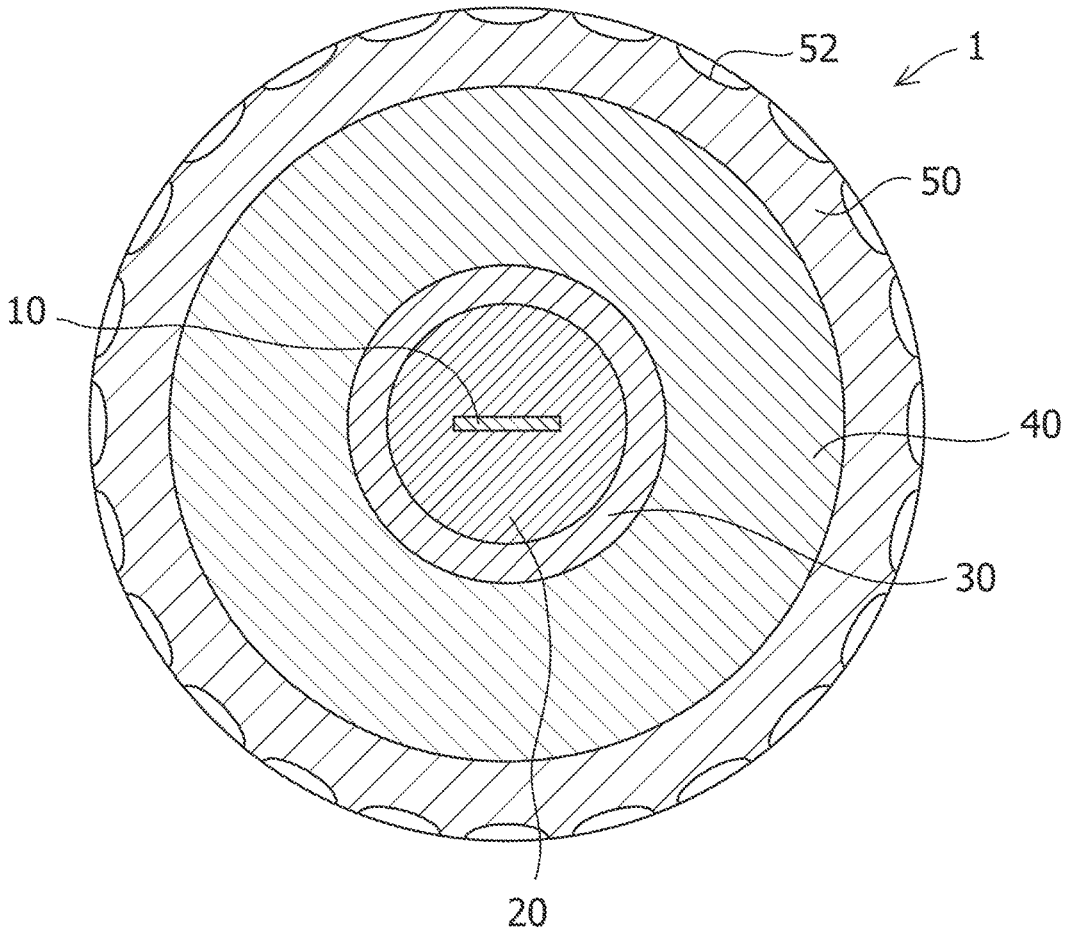
FIG. 1 is a cross-sectional view schematically showing an embodiment of a golf ball according to the present invention.

Hereinafter, an embodiment of a golf ball with a built-in IC chip according to the present invention will be described with reference to the accompanying drawings. The embodiment will be described merely for easier understanding of the present invention; the present invention is not limited thereto. Also, the components in the drawings are not necessarily to scale, emphasis instead being arranged upon clearly illustrating the principles of the present invention.

As shown in FIG. 1, a golf ball 1 according to the present embodiment includes an RFID tag 10 for transmitting and receiving information by wireless communication; the protection layer 20 arranged in the center of the ball and surrounds the RFID tag; a relaxation layer 30 surrounding an outer periphery of the protection layer; the core 40 surrounding an outer periphery of the relaxation layer; and cover 50 surrounding an outer periphery of the core. A plurality of dimples 52 is formed on the surface of the cover 50.

Figure 2:
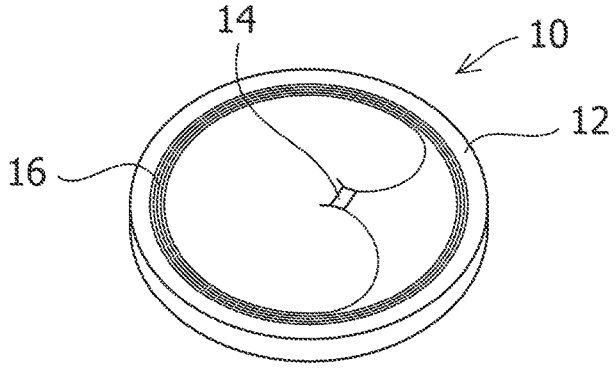
FIG. 2 is a perspective view schematically showing an RFID tag which is built-in in the golf ball shown in FIG. 1.

As shown in FIG. 2, the RFID tag 10 includes an IC chip 14 for storage and computation of the information; and an antenna 16 for exchanging wireless frequency signals. The IC chip 14 and the antenna 16 are directly and connected with each other for electrical connection. The RFID tag 10 is a positive type tag with a built-in battery cell. The built-in battery cell may be preferable a battery cell which can be charged by using a contactless charger. In the present embodiment, the RFID tag 10 is formed on a substrate 12 constituted by the following material similar to a material of the protection layer 20 or inside the substrate 12. However, the configuration of the RFID tag 10 is not limited to this. Specifically, the RFID tag 10 may be a tag which constitutes an RFID system including the IC chip 14 and the antenna 16 and capable of being sufficiently surrounded by the material for forming the protection layer 20.

The outer shape of the protection layer 20 is a substantially spherical shape concentric with the golf ball. The RFID tag 10 is internally arranged in the protection layer 20. The protection layer 20 is constituted by a material with a hardness of Shore D 60 or more. By forming the protection layer 20 with the high hardness material described above, deformation of the protection layer 20 surrounding the RFID tag 10 which may occur when the golf ball 1 is hit with a golf club can be prevented and damaging of the RFID tag 10 and its components including the IC chip 14 and the antenna 16 can be also prevented. For the material hardness of the protection layer 20, the hardness of Shore D 70 or more is more preferable, and the hardness of Shore D 80 or more is further preferable. The upper limit of the material hardness of the protection layer 20 is not particularly limited, and the material hardness of Shore D 100 or less is preferable.

In the protection layer 20, because the active RFID tag 10 is vulnerable to heat, if the curing temperature for the material constituting the protection layer 20 is excessively high, the RFID tag 10, particularly the built-in battery cell (not illustrated), may be damaged when the protection layer 20 surrounding the RFID tag 10 is formed. Accordingly, it is necessary to set the curing temperature for the material of the protection layer 20 at 60° C. or less. This curing temperature is preferably 50° C. or less and more preferably 40° C. or less. The lower limit of the curing temperature is not particularly limited, and the material may be cured at room temperature (25° C.).

Preferable examples of the material with a hardness of Shore D 60 or more and the curing temperature of 60° C. or less include a cold-curing type plastic. For the cold-curing type plastic, resins such as epoxy resin, silicone resin, and urethane resin can be used. For the epoxy resin, an epoxy resin such as bisphenol A epoxy resin can be used, but it is not limited thereto. For the cold-curing type resin, resins such as a two-part liquid mixing curable type resin and a ultraviolet (UV) curable type resin can be used.

To protect the RFID tag 10, it is necessary that the diameter of the protection layer 20 be designed to be larger than the diameter of the antenna 16. It is preferable that the diameter of the protection layer 20 be larger than the diameter of the antenna 16 by a range of 1 to 3 mm. Accordingly, by preferably designing the protection layer 20 so that it has the diameter of 3 mm or more, the IC chip 14 can be sufficiently protected from being damaged. In addition, because the readability of the RFID tag 10 can be increased by extending the antenna 16 largely, it is preferable that the diameter of the protection layer 20 be large. However, if the diameter of the protection layer 20 is excessively large, the resilience and the durability of the golf ball may be affected because the protection layer 20 is constituted by a high hardness material. Accordingly, it is preferable that the diameter of the protection layer 20 be 30 mm or less. With this configuration, a sufficient region of the core 40 arranged externally to the protection layer 20 can be secured and the resilience and the durability of the golf ball can be ensured. The lower limit of the diameter of the protection layer 20 is preferably 4 mm or more, more preferably 5 mm or more. The upper limit of the diameter of the protection layer 20 is preferably 25 mm or less, more preferably 20 mm or less.

The relaxation layer 30 has a function of relaxing the stress generated between the protection layer 20 with the high Shore D hardness of 60 or more as described above and the core 40 which is a rubber composition with a low hardness. To allow the relaxation layer 30 to exhibit the above-described function of relaxing such the stress, the relaxation layer 30 is constituted by a material with a hardness of which the difference between the hardness of the relaxation layer 30 and the hardness of a surface of the core 40 contacting the relaxation layer is Shore D 20 or less. With this configuration, concentration of stress on the core 40, which may otherwise be broken due to concentration of stress, can be prevented because the difference between the hardness of the core 40 and the hardness of the adjacently arranged relaxation layer 30 is small. The difference between the hardness of the material of the relaxation layer 30 and the hardness of the surface of the core 40 is preferably Shore D 15 or less, more preferably Shore D 10 or less, and further preferably Shore D 5 or less.

Specifically, the material hardness of the relaxation layer 30 is preferably Shore D 20 or more, more preferably Shore D 30 or more for its lower limit. The upper limit of the material hardness of the relaxation layer 30 is preferably Shore D 50 or less, more preferably Shore D 40 or less. In particular, it is preferable that the relaxation layer 30 be constituted by a material with a hardness less than the hardness of the surface of the core 40 on the side of the relaxation layer. As described above, if the material hardness of the protection layer is as high as Shore D 60 or more, the entire golf ball can be prevented from being imparted with an excessively high hardness by employing the soft relaxation layer.

For the material constituting the relaxation layer 30, a thermoplastic elastomer is used considering the compatibility with the adjacently arranged core 40 constituted by a rubber composition. With this configuration, concentration of stress that may otherwise arise due to difference in the hardness can be prevented, and also separation of the core 40 from the adjacent layer arranged internally thereto can be prevented.

For the thermoplastic elastomer, a polyester-based thermoplastic elastomer, a styrene-based thermoplastic elastomer, a polyurethane-based thermoplastic elastomer, and the like can be used. However, the thermoplastic elastomer is not limited to them. Among them, considering the compatibility with the core 40, the polyester-based thermoplastic elastomer is preferable. For the polyester-based thermoplastic elastomer, "Hytrel" (registered trademark) produced by Du Pont-Toray Co., Ltd. can be used, for example. This "Hytrel" (registered trademark) has a chemical structure of a block copolymer of a hard segment (polybutylene terephthalate (PBT) and a soft segment (polyether).

Note that if the fusion point of the material constituting the relaxation layer 30 is excessively high, the RFID tag 10 included in the protection layer 20, particularly the built-in battery cell (not illustrated) may be damaged in forming the relaxation layer 30 by injection molding. Accordingly, it is preferable that the material constituting the relaxation layer 30 with a fusion point of 230° C. or less, more preferably 210° C. or less. If a material with the fusion point of the above-described temperature is used, the temperature of the material of the relaxation layer abruptly falls when the material is injected into the molds, and thus the RFID tag included in the protection layer, particularly the built-in battery cell, can be prevented from reaching a high temperature. In contrast, if a material with an excessively low fusion point is used as the material constituting the relaxation layer 30, in forming the cover 50 by vulcanization, the relaxation layer 30 arranged internally at the cover 50 may melt or be damaged. Accordingly, it is preferable that a material with the fusion point of 80° C. or more, or more preferably 150° C. or more, be used.

It is preferable that the relaxation layer 30 uniformly surround the outer periphery of the protection layer 20. The lower limit of the thickness of the relaxation layer 30 is preferably 0.5 mm or more, more preferably 2 mm or more, further preferably 3 mm or more, and most preferably 4 mm or more. On the other hand, the upper limit of the thickness of the relaxation layer 30 is preferably 10 mm or less, more preferably 8 mm or less, and further preferably 6 mm or less. The relaxation layer 30 is shown as including one layer in FIG. 1, but the configuration is not limited thereto. For example, the relaxation layer 30 may be a relaxation layer including a plurality of layers.

The core 40 can be constituted by a rubber composition containing rubber as its main component. For the rubber (base material rubber) that is the main component, a variety of synthetic rubbers and natural rubbers can be used. Examples of such a rubber that can be used include, but are not limited to: polybutadiene rubber (BR), styrene-butadiene rubber (SBR), natural rubber (NR), polyisoprene RUBBER (IR), polyurethane rubber (PU), butyl rubber (IIR), vinyl polybutadiene rubber (VBR), ethylene propylene rubber (EPDM), nitrile rubber (NBR), and silicone rubber. For the polybutadiene rubber (BR), polybutadienes such as 1,2-polybutadiene and CIS-1,4-polybutadiene can be used.

To the core 40, in addition to the base material rubber described above, agents and substances such as co-crosslinking agents, crosslinking initiators, fillers, age resistors, isomerization agents, peptizing agents, sulfur, and organic sulfur compounds can be optionally added. As the main component of the core 40, resins can be used instead of rubber. For example, thermoplastic elastomers, ionomer resins, or a mixture thereof can be used.

For the co-crosslinking agent, it is preferable to use α,β-unsaturated carboxylic acid or metal salts thereof. However, the co-crosslinking agent is not limited thereto. Examples of the α,β-unsaturated carboxylic acid or the metal salts thereof include: acrylic acid, methacrylic acid, and zinc salts, magnesium salts, and calcium salts thereof. The lower limit of an amount of the co-crosslinking agent is, but is not limited to, preferably about 5 parts by weight or more, more preferably about 10 parts by weight in relation to 100 parts by weight of the base material rubber. The upper limit of an amount of the co-crosslinking agent is, but is not limited to, preferably about 70 parts by weight or less, more preferably about 50 parts by weight in relation to 100 parts by weight of the base material rubber.

For the crosslinking initiator, it is preferable to use an organic peroxide. However, the crosslinking initiator is not limited thereto. Examples of the organic peroxide include: dicumyl peroxide, t-butyl peroxybenzoate, di-t-butyl peroxide, and 1,1-bis(t-butylperoxy)3,3,5-trimethylcyclohexane. For example, the lower limit of an amount of the crosslinking initiator is, but is not limited to, preferably about 0.10 parts by weight, more preferably about 0.15 parts by weight, and further preferably about 0.30 parts by weight in relation to 100 parts by weight of the base material rubber. The upper limit of an amount of the crosslinking initiator is, but is not limited to, preferably about 8 parts by weight, more preferably about 6 parts by weight in relation to 100 parts by weight of the base material rubber.

For the filler, materials such as silver, gold, cobalt, chromium, copper, iron, germanium, manganese, molybdenum, nickel, lead, platinum, tin, titanium, tungsten, zinc, zirconium, barium sulfate, zinc oxide, and manganese oxide can be used. However, the filler is not limited to them. It is preferable that the filler be in the form of powder. For example, the lower limit of an amount of the filler is, but is not limited to, preferably about 1 part by weight, more preferably 2 parts by weight, further preferably 3 parts by weight in relation to 100 parts by weight of the base material rubber. The upper limit of an amount of the filler is, but is not limited to, preferably about 100 parts by weight, more preferably about 80 parts by weight, further preferably about 70 parts by weight in relation to 100 parts by weight of the base material rubber.

For the age resistor, commercial products such as NOCRAC NS-6 (a product of Ouchi Shinko Chemical Industrial Co., Ltd.) can be used. However, the age resistor is not limited thereto. The lower limit of an amount of the age resistor is, but not limited to, preferably about 0.1 parts by weight, more preferably 0.15 parts by weight in relation to 100 parts by weight of the base material rubber. The upper limit of an amount of the age resistor is, but is not limited to, preferably about 1.0 mass parts, and more preferably, about 0.7 mass parts in relation to 100 parts by weight of the base material rubber.

By adding an organic sulfur compound (peptizer), the resilience of the core 40 can be improved. The organic sulfur compound is selected from the group consisting of thiocarboxylic acids and metal salts thereof. Examples of thiophenols and thiocarboxylic acids include: thiophenols such as pentachlorothiophenol, 4-t-butyl-o-thiophenol, 4-t-butyl thiophenol, 2-benzamide thiophenol; and thiocarboxylic acids such as thiobenzoic acid. For metal salts thereof, it is preferable to use zinc salts. The lower limit of an amount of the organic sulfur compound is, but is not limited to, preferably about 0.5 parts by weight, more preferably about 1 part by weight in relation to 100 parts by weight of the base material rubber. The upper limit of an amount of the organic sulfur compound is, but is not limited to, preferably about 3 parts by weight, more preferably about 2 parts by weight in relation to 100 parts by weight of the base material rubber.

With respect to the hardness of the core 40, it is preferable that the core 40 be soft. Because the protection layer 20 is constituted by a high hardness material, the entire golf ball can be prevented from being imparted with an excessively high hardness by imparting a low hardness to the core 40 so that the core 40 becomes soft. The hardness of the core 40 herein refers to the hardness of the surface of the core 40 contacting the relaxation layer. The upper limit of this hardness of the core 40 is preferably Shore D 60 or less, more preferably Shore D 50 or less, and further preferably Shore D 40 or less. On the other hand, the lower limit of the hardness of the core 40 is preferably Shore D 20 or more, more preferably Shore D 30 or more. However, the upper limit and the lower limit of the hardness of the core 40 are not limited to the above-described hardness values. It is preferable that the hardness of the core 40 be within the above-described range of hardness up to the location in which the depth from the surface of the core 40 on the side of the relaxation layer is at least 10 mm, although this may differ according to the thickness of the core. Note that the hardness of the material of the core 40 may be higher than the hardness of the relaxation layer 30 as described above.

It is preferable that the core 40 uniformly surround the outer periphery of the relaxation layer 30. The lower limit of the thickness of the core 40 is preferably 4.5 mm or more, more preferably 10 mm or more, in order to impart a produced resilience to the golf ball. On the other hand, the upper limit of the thickness of the core 40 is not particularly limited, and it is preferably 25 mm or less, more preferably 20 mm or less. However, the lower limit and the upper limit of the thickness of the core 40 are not limited to the above-described thickness. The core 40 shown in FIG. 1 includes one layer. However, the configuration of the core 40 is not limited thereto. For example, the core 40 may be a core including a plurality of layers. If this configuration is employed, it is preferable that the hardness of each layer of the core be increased from the inside of the golf ball toward the outer periphery of the golf ball.

With respect to a material constituting the cover 50, the cover 50 can be formed by using ionomer resins, polyurethane-based thermoplastic elastomers, thermosetting polyurethanes, or a mixture thereof. However, the material constituting the cover 50 is not limited thereto. In addition, to the cover 50, in addition to the main component described above, other thermoplastic elastomers, polyisocyanate compounds, fatty acid or derivatives thereof, basic inorganic metal compounds, fillers, and the like can be added.

The hardness of the material constituting the cover 50 is preferably Shore D 50 or more, more preferably Shore D 55 or more. Moreover, the hardness of the material constituting the cover 50 is preferably Shore D 75 or less, more preferably Shore D 70 or less, further preferably 65 or less. However, the hardness of the material constituting the cover 50 is not limited to the above-described hardness.

The lower limit of the thickness of the cover 50 is preferably 0.2 mm or more, more preferably 0.4 mm or more. Moreover, the upper limit of the thickness of the cover 50 is preferably 4 mm or less, more preferably 3 mm or less, further preferably 2 mm or less. However, the upper limit and the lower limit of the thickness of the cover 50 are not limited to the above-described thickness. A plurality of dimples 52 is formed on the surface of the cover 50. The size, the shape, the number, and the like can be appropriately designed according to the aerodynamic performance desired for the golf ball 1.

An intermediate layer (not illustrated) may be optionally provided between the core 40 and the cover 50. An intermediate layer having a core-like function may be formed, and alternatively, an intermediate layer having a cover-like function may be formed. In addition, a plurality of intermediate layers may be provided. In this configuration, a first intermediate layer having a core-like function and a second intermediate layer having a cover-like function, for example, may be provided.

For the material of the intermediate layer, it is preferable that the following heated mixture be used as the main material. However, the material of the intermediate layer is not limited to the following materials. By using the material for the intermediate layer, spinning imparted when the golf ball 1 is hit can become low and thus a large carry can be obtained. The heated mixture includes:

(a) a binary random copolymer of olefin-unsaturated carboxylic acid and/or a metal ion-neutralized product of a binary random copolymer of olefin-unsaturated carboxylic acid; (b) a base resin prepared by compounding a ternary random copolymer of olefin-unsaturated carboxylic acid-unsaturated carboxylic ester and/or a metal ion-neutralized product of a ternary random copolymer of olefin-unsaturated carboxylic acid-unsaturated carboxylic ester; (e) a non-ionomer thermoplastic elastomer mixed with the base resin so that the weight ratio between the base resin and the elastomer becomes 100:0 to 50:50; (c) 5 to 150 parts by weight of fatty acid and/or a derivative thereof with a molecular weight of 228 to 1,500, in relation to 100 parts by weight of a resin component including the base resin and the component (e); and (d) 0.1 to 17 parts by weight of a basic inorganic metal compound capable of neutralizing non-neutralized acid radicals in the base resin and the component (c).

Note that the term "main material" herein refers to a material of 50 parts by weight or more, preferably 60 parts by weight or more, further preferably 70 parts by weight or more in relation to the total weight of the intermediate layer.

The hardness of a material constituting the intermediate layer is preferably Shore D 40 or more, more preferably Shore D 45 or more, further preferably Shore D 50 or more. It is preferable that the hardness of the material constituting the intermediate layer be lower than the hardness (softer than) the cover 50. Specifically, the hardness of the material constituting the intermediate layer is preferably Shore D 65 or less, more preferably Shore D 60 or less.

The thickness of the intermediate layer is preferably 0.5 mm or more, more preferably 1 mm or more. In addition, the thickness of the intermediate layer is preferably 10 mm or less, more preferably 5 mm or less, further preferably 3 mm or less. However, the thickness of the intermediate layer is not limited to the lower limit and the upper limit described above.

Next, an embodiment of a method of producing the golf ball 1 with a built-in RFID tag having the above-described configuration will be described. A method of preparing the protection layer 20 is not particularly limited, and the protection layer 20 can be formed by methods such as compression molding and injection molding. Specifically, the RFID tag 10 is placed in advance inside molds for the protection layer shaped in a predetermined spherical shape, a material having a predetermined hardness is charged into the molds by pressing or injection, and thereby the protection layer 20 including the RFID tag 10 sufficiently surrounded by the material with a predetermined hardness can be formed. The outer peripheral surface of the protection layer 20 may be processed so as to form asperities thereon to increase the property of adhesion to the relaxation layer 30.

A method of forming the relaxation layer 30 is not particularly limited, and the relaxation layer 30 can be formed by injection molding, for example. Specifically, the protection layer 20 formed in the above-described manner is placed into molds for the relaxation layer in the center of the molds, a material for the relaxation layer 30 is charged into the molds by injection so as to be placed over the protection layer 20, and thus the relaxation layer 30 can be formed.

A method of forming the core 40 is not particularly limited, and the core 40 can be formed by half-cup molding, for example. Specifically, a material including the base material rubber is kneaded by using a kneader, then a pair of half-cups is molded by using the resulting kneaded product, the obtained pair of half-cups covering the relaxation layer 30 is heated and vulcanized, the half-cups are thus coupled together, and thus the core 40 surrounding the outer periphery of the relaxation layer 30 can be formed.

A method of forming the cover 50 is not particularly limited, and the cover 50 can be formed by injection molding, for example. Specifically, the core 40 formed in the above-described manner is placed in molds for the cover in the center of the molds, a material of the cover is charged into the molds by injection so as to cover the core 40, and thus the cover 50 can be formed. The golf ball 1 including the built-in RFID tag 10 can be produced in the above-described manner. Note that if the antenna 16 of the RFID tag 10 is directional, a mark which indicates a location of direction in which communication with the reading apparatus can be easily performed may be provided on the surface of the cover 50. For example, if the antenna 16 has a configuration including a plurality of rings as shown in FIG. 2, the mark can be indicated at a location on the surface of the ball in a direction normal to the plane of the plurality of rings.

The shape of the RFID tag 10 may be a shape of a disk shown in FIG. 2 or may alternatively be a shape suitable for supporting or accommodating the IC chip 14 and the antenna 16. For example, the RFID tag 10 may take a shape of a tetragon such as square and rectangle or any other such suitable shape. The thickness of the RFID tag 10 is not particularly limited either, and may be a thickness thick enough to support or accommodate the IC chip 14 and the antenna 16. The IC chip 14 and the antenna 16 may be alternatively built directly in the protection layer 20 instead of being supported by or accommodated inside the substrate 12 if no particular problem may be caused.

The shape of the antenna 16 is not particularly limited, and may be a shape suitable for accommodating the antenna. For example, the shape of the antenna 16 may be a shape in which a plurality of rings are overlapped on a plane as shown in FIG. 2 or may alternatively be a shape in which a plurality of rings three-dimensionally intersect with one another so as to maintain the symmetry of the golf ball. In addition, a dummy antenna that is not for electrical connection with the IC chip 14 may be arranged to maintain the symmetry of the golf ball.

Further, the configuration of the antenna 16 is not limited to the configuration in which it is connected with the IC chip 14 as shown in FIG. 2, and alternatively, the configuration of the antenna 16 may be such that an antenna for intercommunication with the external reading apparatus with radio waves is arranged on the surface of the core or the surface of the intermediate layer of the golf ball and that a boost antenna for intercommunication with the above-described antenna with radio waves, which is connected with the IC chip, is further arranged in the RFID tag.

EXAMPLE

Golf balls, each including the RFID tag having the configurations shown in Table 2, were prepared for the Example of the present invention and the Comparative Examples, and tests were carried out for measuring the durability of the golf balls and the availability of communication with the built-in RFID tag. Table 2 shows the materials of the protection layers shown in FIG. 1. Table 3 shows the materials of the relaxation layers shown in FIG. 1. Table 4 shows the compound (unit: parts by weight) of the materials of the cores shown in FIG. 1. Table 5 shows the compound (unit: parts by weight) of the materials of the covers and the intermediate layers shown in FIG. 1. For the active RFID tag arranged inside each of the protection layers, a commercially available active RFID tag was commonly used.

TABLE 1

| | | Example | | | Comparative Example | | | | | |
|---|---|---|---|---|---|---|---|---|---|---|
| | | 1 | 2 | 3 | 1 | 2 | 3 | 4 | 5 | 6 |
| Protection layer | Outer diameter | 15 | 10 | 15 | 15 | 15 | 15 | 15 | 15 | 15 |
| | Material | A | A | A | A | A | B | C | A | A |
| | Material hardness P | 80 | 80 | 80 | 80 | 80 | 55 | 65 | 80 | 80 |
| Relaxation layer | Outer diameter | 20 | 15 | 20 | — | 20 | 20 | 20 | 20 | 20 |
| | Material | D | D | E | — | E | D | D | F | G |
| | Material hardness R | 40 | 40 | 30 | — | 30 | 40 | 40 | 72 | 45 |
| Core | Outer diameter | 37.7 | 37.7 | 37.7 | 37.7 | 37.7 | 37.7 | 37.7 | 37.7 | 37.7 |
| | Material | H | H | H | H | I | H | H | H | H |
| | Surface hardness C | 45 | 45 | 45 | 45 | 55 | 45 | 45 | 45 | 45 |
| Intermediate layer | Thickness | 1.7 | 1.7 | 1.7 | 1.7 | 1.7 | 1.7 | 1.7 | 1.7 | 1.7 |
| | Material hardness | 62 | 62 | 62 | 62 | 62 | 62 | 62 | 62 | 62 |
| | Material | J | J | J | J | J | J | J | J | J |
| Cover | Thickness | 0.8 | 0.8 | 0.8 | 0.8 | 0.8 | 0.8 | 0.8 | 0.8 | 0.8 |
| | Material hardness | 48 | 48 | 48 | 48 | 48 | 48 | 48 | 48 | 48 |
| | Material | K | K | K | K | K | K | K | K | K |
| Hardness difference P-C | | 35 | 35 | 35 | 35 | 25 | 10 | 20 | 35 | 35 |
| Hardness difference P-R | | 40 | 40 | 50 | — | 50 | 15 | 25 | 8 | 35 |
| Hardness difference R-C | | −5 | −5 | −15 | — | −25 | −5 | −5 | 27 | 0 |
| COR durability | | Good | Very good | Good | Poor | Poor | Poor | Good | Poor | Fair |
| Communication availability | | Yes | Yes | Yes | Yes | Yes | No | No | Yes | Yes |

TABLE 2

| | Material | Curing temperature [° C.] |
|---|---|---|
| A | Epoxy resin | 20 |
| B | Ionomer A | 90 |
| C | Polycarbonate | 250 |

TABLE 3

| | Material |
|---|---|
| D | Hytrel 4001 |
| E | Hytrel 3001 |
| F | Hytrel 7247 |
| G | Ionomer B |

For the epoxy resin, a product called "M-4", a bisphenol A type epoxy resin produced by Terada Co., Ltd. was used.

For the Ionomer A, a mixture of "HIMILAN 1605" and "HIMILA 1706", products of Du Pont-Mitsui Polychemicals, was used.

For the polycarbonate, "TARFLON A", a polycarbonate produced by Idemitsu Kosan Co., Ltd., was used.

Hytrel is a polyester-based thermoplastic elastomer produced by Du Pont-Toray Co., Ltd. having a chemical structure of a block copolymer of a hard segment (polybutylene terephthalate (PBT) and a soft segment (polyether) was used.

For the Ionomer B, "HPF 2000", a product of Du Pont, was used.

TABLE 4

| | | H | I |
|---|---|---|---|
| Polybutadiene | | 100 | 100 |
| Organic peroxide | Perhexa C | 0.3 | 0.3 |
| | Percumyl D | 0.3 | 0.3 |
| Zinc oxide | | 12.5 | 9.5 |
| Age resistor | | 0.1 | 0.1 |
| Zinc acrylate | | 28.0 | 35.0 |
| Pentachlorothiophenol zinc salt | | 1.0 | 1.0 |

For the polybutadiene, BR 730, a product of JSR Corporation, was used as the base material rubber.

Perhexa C is a product of NOF Corporation which is a mixture of 1,1-di(t-butylperoxy)cyclohexane and silica. Perhexa C was used as the crosslinking initiator.

Percumyl D is a product of NOF Corporation, which is a dicumyl peroxide.

For the zinc oxide, three types of "Zinc Oxide", products of Sakai Chemical Industry Co., Ltd., were used.

For the age resistor, NOCRAC NS-6, a product of Ouchi Shinko Chemical Industrial Co., Ltd., which is 2,2'-methylene-bis(4-methyl-6-t-butylphenol), was used.

For the zinc acrylate, WN 86, a product of Nippon Shokubai Co., Ltd., was used.

TABLE 5

| | J | K |
|---|---|---|
| HIMILAN 1605 | — | 40 |
| HIMILAN 1706 | — | 50 |
| HIMILAN 1601 | — | 10 |
| HIMILAN 1557 | 75 | — |
| HIMILAN 1855 | 25 | — |

HIMILAN 1605, HIMILAN 1706, HIMILAN 1601, HIMILAN 1557, and HIMILAN 1855 are ionomer resin products of Du Pont-Mitsui Polychemicals.

A method of measurement of the surface hardness of the cores shown in Table 1 will be described. The surface hardness of the cores was measured in such a manner that a type D durometer compliant with the American Society for Testing and Materials (ASTM) D2240-95 standard was vertically pressed against the surface of the core contacting the relaxation layer at the stage in which the layer to be measured. The above-described hardness values are measurement values obtained after the temperature was controlled to 23° C.

A method of measurement of the material hardness of the protection layer and the relaxation layer shown in Table 1 will be described. The material to be measured was formed so as to take a sheet-like shape with the thickness of 2 mm, the materials were stored for 2 weeks at 23° C., then they were laminated to form a lamination with the thickness of 6 mm or more, and the material hardness thereof was measured by using a type D durometer compliant with the ASTM D2240-95 standard.

For the "COR durability" shown in Table 1, the durability of the golf balls and the RFID tag inside each golf ball were evaluated by using an ADC Ball CORE Durability Tester, a product of Automated Design Corporation (U.S.). The tester has a function of ejecting a golf ball by applying air pressure and serially colliding the ejected golf ball against two metal boards installed in parallel with each other. The rate of impingement onto the metal board was set at 43 m/s. An average value of the number of times of ejections required until each golf ball was broken or until the RFID tag inside each golf ball became unreadable was calculated. The "average value" herein refers to a value obtained in such a manner that five sample balls were prepared, the balls were ejected, and the number of times of ejections required until the RFID tag included in each of the five balls became unreadable was averaged. For the evaluation shown in Table 1, "very good" denotes an average value of 100 times, "good" denotes an average value of 60 to 99 times, "fair" denotes an average value of 20 to 59 times, and "poor" denotes an average value below 20 times.

For the "communication availability" shown in Table 1, the evaluation was performed according to whether it was able to read information from the RFID tag with an RFID reader after each golf ball was molded. For the evaluation shown in Table 1, "Yes" denotes that the information was readable while "No" denotes that the information was unreadable.

As shown in Table 1, for the golf balls of Examples 1 to 3, in which the protection layer was formed by using a material with a hardness of Shore D 80 or more and the relaxation layer was formed by using a material with a hardness that was different from the hardness of the surface of the core was Shore D 5 to 15 arranged between the protection layer and the core, deformation of the protection layer occurring when the golf ball was hit was suppressed, and thus, the durability was excellent. Because the protection layer was formed by using an epoxy resin that cures at room temperature for the golf balls of Examples 1 to 3, communication was possible even if an active RFID tag that was vulnerable to heat was used.

On the other hand, for the golf ball of Comparative Example 1, in which the core with a hardness of its surface contacting the protection layer was Shore D 45 and the core was arranged adjacently to the protection layer formed by using a material with the hardness of Shore D 80, the difference of hardness between the protection layer and the core was as large as Shore D 35, and thus, the core was broken due to concentration of stress, and the golf ball was easily broken. For the golf ball of Comparative Example 2, in which the relaxation layer was arranged between the protection layer and the core but the difference between the material hardness of the relaxation layer and the surface hardness of the core was as large as Shore D 25, concentration of stress occurred due to the large difference of hardness, the core was broken and the golf ball was easily broken.

For the golf balls of Comparative Examples 3 and 4, in which the protection layer was formed by using an ionomer and a thermoplastic resin although the relaxation layer was arranged between the protection layer and the core, in some samples, the communication had already failed after the golf ball was formed due to heat applied in the injection molding. The COR durability was tested for the samples of the Comparative Examples 3 and 4 for which communication was available. In this test, for the golf ball of Comparative Example 3 with a hardness of the protection layer as low as Shore D 55, the protection layer was deformed and the RFID tag was damaged, and thus, no sufficient durability was obtained.

For the golf ball of Comparative Example 5, in which the relaxation layer was formed by using a material with a hardness of a Shore D value in between the material hardness of the protection layer and the surface hardness of the core, due to the difference of hardness between the protection layer and the core as large as Shore D 27, the core was broken due to concentration of stress, and the golf ball was easily broken. For the golf ball of Comparative Example 6, the core was separated from the relaxation layer, the golf ball was broken, and no sufficient durability was obtained.

What is claimed is:

1. A golf ball with a built-in integrated circuit (IC) chip, the golf ball comprising:

an IC chip;

a protection layer surrounding an outer periphery of the IC chip; a curing temperature of the protection layer being 60° C. or less and the protection layer being formed with a material having a hardness of Shore D 60 or more a relaxation layer surrounding an outer periphery of the protection layer;

a core surrounding an outer periphery of the relaxation layer, the core being formed with a rubber composition; and a cover surrounding an outer periphery of the core, wherein the relaxation layer is formed with a thermoplastic elastomer-based material having a hardness with a difference from a hardness of a surface of the core on a side contacting the relaxation layer of Shore D 20 or less, wherein an outer shape of the protection layer is a substantially spherical shape concentric with the golf ball, and wherein the protection layer has a diameter of at least 3 mm.

2. The golf ball according to claim 1, wherein the thermoplastic elastomer is a polyester-based thermoplastic elastomer.

3. The golf ball according to claim 1, wherein the hardness of the material of the relaxation layer is less than the hardness of the surface of the core on the side contacting the relaxation layer.

4. The golf ball according to claim 1, wherein the hardness of the material of the relaxation layer is Shore D 20 to 50.

5. The golf ball according to claim 1, wherein the material of the protection layer is an epoxy resin which cures at room temperature.

6. The golf ball according to claim 1, wherein the relaxation layer has a thickness of 0.5 to 10 mm.

7. The golf ball according to claim 1, wherein the relaxation layer has an outer diameter of at least 15 mm.

8. The golf ball according to claim 1, wherein the IC chip constitutes an RFID tag together with an antenna connected with the IC chip.

9. The golf ball according to claim 8, wherein a diameter of the protection layer is larger than a diameter of the antenna by a range of 1 to 3 mm.

10. A golf ball with a built-in integrated circuit (IC) chip, the golf ball comprising:

an IC chip;

a protection layer surrounding an outer periphery of the IC chip, a curing temperature of the protection layer being 60° C. or less and the protection layer being formed with a material having a hardness of Shore D 60 or more;

a relaxation layer surrounding an outer periphery of the protection layer;

a core surrounding an outer periphery of the relaxation layer, the core being formed with a rubber composition; and a cover surrounding an outer periphery of the core, wherein the relaxation layer is formed with a thermoplastic elastomer-based material having a hardness with a difference from a hardness of a surface of the core on a side contacting the relaxation layer of Shore D 20 or less, wherein the IC chip constitutes an RFID tag together with an antenna connected with the IC chip, and wherein an outer shape of the protection layer is a substantially spherical shape concentric with the golf ball.

11. The golf ball according to claim 10, wherein a diameter of the protection layer is larger than a diameter of the antenna by a range of 1 to 3 mm.

12. The golf ball according to claim 10, wherein the thermoplastic elastomer is a polyester-based thermoplastic elastomer.

13. The golf ball according to claim 10, wherein the hardness of the material of the relaxation layer is less than the hardness of the surface of the core on the side contacting the relaxation layer.

14. The golf ball according to claim 10, wherein the hardness of the material of the relaxation layer is Shore D 20 to 50.

15. The golf ball according to claim 10, wherein the material of the protection layer is an epoxy resin which cures at room temperature.

16. The golf ball according to claim 10, wherein the relaxation layer has a thickness of 0.5 to 10 mm.

17. The golf ball according to claim 10, wherein the relaxation layer has an outer diameter of at least 15 mm.

* * * * *